US009234711B2

(12) United States Patent
Shen

(10) Patent No.: US 9,234,711 B2
(45) Date of Patent: Jan. 12, 2016

(54) COIL AND HEAT EXCHANGER WITH THE SAME

(75) Inventor: Weili Shen, Jiande (CN)

(73) Assignee: Hangzhou Shenshi Energy Conservation Technology Co., Ltd., Zhejiang (CN)

( * ) Notice: Subject to any disclaimer, the term of this patent is extended or adjusted under 35 U.S.C. 154(b) by 845 days.

(21) Appl. No.: 13/515,616

(22) PCT Filed: Jun. 22, 2010

(86) PCT No.: PCT/CN2010/000917

§ 371 (c)(1), (2), (4) Date: Aug. 17, 2012

(87) PCT Pub. No.: WO2011/072470

PCT Pub. Date: Jun. 23, 2011

(65) Prior Publication Data

US 2012/0298342 A1 Nov. 29, 2012

(30) Foreign Application Priority Data

Dec. 14, 2009 (CN) ..... 2009 1 0250518

(51) Int. Cl.
*F28F 9/013* (2006.01)
*F28F 9/22* (2006.01)
*F28D 7/08* (2006.01)

(52) U.S. Cl.
CPC ..... *F28F 9/013* (2013.01); *F28D 7/082* (2013.01); *F28F 9/22* (2013.01)

(58) Field of Classification Search
CPC ..... F28D 7/082; F28D 7/085; F28F 9/22; F28F 9/013
USPC ..... 165/163, 158, 178
See application file for complete search history.

(56) References Cited

U.S. PATENT DOCUMENTS

| | | | | | |
|---|---|---|---|---|---|
| 1,456,255 | A | * | 5/1923 | Shaw | 165/143 |
| 2,171,369 | A | * | 8/1939 | Marcus | 165/163 |
| 2,199,216 | A | * | 4/1940 | Conti | 165/145 |
| 3,830,293 | A | * | 8/1974 | Bell | 165/174 |

FOREIGN PATENT DOCUMENTS

| | | | | |
|---|---|---|---|---|
| CN | 2198589 | Y | | 5/1995 |
| CN | 2524163 | Y | | 12/2002 |
| CN | 101738121 | A | | 6/2010 |
| CN | 101738122 | A | | 6/2010 |
| DE | 937884 | C | * | 1/1956 |
| DE | 3645307 | C2 | * | 7/1997 |
| FR | 2570173 | A | * | 3/1986 |
| GB | 122626 | A | | 12/1918 |
| JP | 1084098 | A | | 3/1989 |

OTHER PUBLICATIONS

International Search Report w/translation from PCT/CN2010/000917 dated Oct. 14, 2010 (6 pages).

* cited by examiner

*Primary Examiner* — Tho V Duong
(74) *Attorney, Agent, or Firm* — Osha Liang LLP

(57) ABSTRACT

A coil consists of several arc-shaped tubes whose first end is connected to tail end sequentially to form a continuous curve. The angle spanning between the first end and the tail end of the arc-shaped tube is greater than 180 degrees. The center lines of joints of two adjacent arc-shaped tubes have a common tangent point or the center lines of joints of two adjacent arc-shaped tubes are in tangent connection with a center line of a straight tube. The coil and the heat exchanger with the same have impact construction, small volume and high heat exchange efficiency.

9 Claims, 6 Drawing Sheets

COIL AND HEAT EXCHANGER WITH THE SAME

FIELD OF THIS INVENTION

This invention refers to a pipe and a heat exchanger, in particular, refers to a coiled pipe and a heat exchanger using the same.

DESCRIPTION OF THE RELATED ART

The heat exchanger is a device for exchanging heat between cold fluid and hot fluid. In chemical industry, petroleum industry, power industry, and food industry, the heat exchanger is widely applied as a heating device, a cooling device, or even a condenser. The heat exchanger can be grouped into three categories in terms of the way of heat exchanging: 1. surface heat exchanger; 2. contact heat exchanger; 3. regenerative heat exchanger. The surface heat exchanger can be grouped into two categories, such as tubular heat exchanger (e.g. shell and tube heat exchanger, coiled pipe heat exchanger, bushing heat exchanger, fountain heat exchanger and air cooler etc.) and plate heat exchanger (e.g. spiral plate heat exchanger, flat plate heat exchanger, and plate-fin heat exchanger etc.).

The heat exchanging surface of the shell and tube heat exchanger is the wall of tube bundle enclosed in the housing, and one sort of fluid named tube side fluid flows in the tube bundle, and the other sort of fluid named housing side fluid flows outside the tube bundle. The shell and tube heat exchanger is simply structured and easy to operate, and can be made of different types of materials, especially metal, This heat exchanger can be used in high temperature and high pressure environment. Therefore, currently, it is the most widely used heat exchanger.

The Chinese patent No. CN2524163Y discloses a counter flow shell and tube heat exchanger comprising a rectangle housing, a coiled pipe arranged in the housing, electric heater, tritorium connected to the inlet and outlet of the coiled pipe and a collecting box, further comprising a liquid inlet, liquid outlet, washing liquid outlet, drain outlet, temperature sensor installation seat, spoiler, and cross flow plate supporter arranged on the housing. A curved liquid passage is formed by a guiding plate arranged in the internal room of the rectangle housing, and the spoiler and the cross flow plate supporters are arranged on the internal wall of the curved liquid passage; the refrigerant-side passage is a coiled pipe whose flexing angle is 180 degree.

In the existing technology, the adjacent two refrigerant-side passages in the counter flow tubular heat exchanger are parallel with each other. Two curved connecting pipes at the ends of the refrigerant-side passage are connected to the adjacent upper and lower refrigerant-side passage, forming a coiled pipe in "U" shape. However, as the liquid flows in the coiled pipe, in order to the improve the heat exchange, the internal wall of the coiled pipe is always designed into internal thread structure or micro-fin structure, and in order to keep the internal thread structure or micro-fin structure not deformed, the semi-diameter of curved part of the coiled pipe is short, and there are very few curved parts of the coiled pipe, and this results in the fact that a lot of room is wasted and not well utilized. Consequently, there are very few number of coiled pipes in the unit volume, and the heat exchanger area is very small in the unit volume, and this causes the size of a heat exchange is too large, and the thermal coefficient of the heat exchanger is also too small, thereby causing a low heat exchange efficiency of the heat exchanger.

SUMMARY OF THE INVENTION

In view of the above-described problem, it is one objective of the invention to provide a small sized coiled pipe that may improve the room utilization, the compactness and the heat exchange efficiency and also provide a heat exchanger using the same.

To achieve the above objective, in accordance with one embodiment of the invention provided is a coiled pipe, comprising a plurality of curved segments and straight segments integrally cast together; each said curved segment has a first end and a second end; each straight segment is disposed between each two curved segments; flexing angle of each curved segment is larger than 180 degree; the first end and the second end of the curved segments are on the same plane; the central lines of two adjacent curved segments have a common tangency point at the joint of the two adjacent curved segments; or the central lines of two adjacent curved segments are tangentially connected to a central line of a straight segment.

In a class of this embodiment, the flexing angle of each curved segment is 186 degree-286 degree.

The invention further provides a heat exchanger, comprising a housing, a distribution tube, an effuser and a coiled pipe; wherein, the housing is constituted by said housing is constituted by a frame body, a first side plate and a second side plate disposed opposite to said first side plate, said first side plate and said second side plate are in sealed connection with said frame body to form an enclosure; the distribution tube has a distribution opening disposed thereon and the effuser has a collecting opening disposed thereon; the effuser penetrates into the housing and are in sealed connection with the same respectively through a distribution tube installation hole and an effuser installation hole formed on the housing; and the coiled pipe is placed inside the housing; one end of the coiled pipe is connected to the distribution opening while the other end of the coiled pipe is connected to the collecting opening; and the coiled pipe comprises a plurality of curved segments and straight segments integrally cast together; each curved segment has a first end and a second end; each said straight segment is disposed between each two said curved segments; flexing angle of each curved segment is larger than 180 degree; the first end and the second end of the curved segments are on the same plane; the central lines of two adjacent curved segments have common tangency point at the joint of the two adjacent curved segments; or central lines of two adjacent curved segments are tangentially connected to the central line of a straight segment.

In a class of this embodiment, the flexing angle of each curved segment is 186 degree-286 degree.

In a class of this embodiment, the coiled pipe is disposed parallel with the first side plate and the second side plate.

In a class of this embodiment, the first side plate or the second side plate has a plurality of guiding devices, or both the first side plate and the second side plate respectively have a plurality of guiding devices disposed thereon; the guiding devices coordinate with the coiled pipe, and the generatrix of each guiding device is perpendicular to the first side plate and/or the second side plate respectively.

In a class of this embodiment, some of the guiding devices coordinate with the curved segments located on one side relative to a connection line between the first end and the second end of the curved segment, which are formed on the first side plate, and the other guiding devices are formed on the second side plate.

In a class of this embodiment, the guiding device comprises a plurality of guiding pillars; each guiding pillar comprises a guiding cylinder and a connecting wall; the guiding cylinders coordinate with the curved segments; and a transition member is disposed on one end of the connecting wall, which is far from the guiding cylinder; the transition member coordinates with the curved segment adjacent thereto.

In a class of this embodiment, the frame body is in demountable connection with the first side plate.

In a class of this embodiment, the frame body is in demountable connection with the second side plate.

In a class of this embodiment, the first side plate or the second side plate is connected with the frame body through a screw bolt, or both the first side plate and the second side plate are connected with the frame body through screw bolts.

In a class of this embodiment, a sealed connection between the distribution tube and the distribution tube installation hole is formed through a first connection plate in sealed connection with the distribution tube and integrally cast with the first side plate; a sealed connection between the effuser and the effuser installation hole is formed via a second connection plate in sealed connection with the effuser and integrally cast with the first side plate.

In a class of this embodiment, a plurality of monolayer coiled pipes are connected to each other through a plurality of straight segments and disposed on the same plane to form a monolayer coiled pipe array; and two ends of the monolayer coiled pipe array are respectively connected to the distribution opening and the collecting opening.

In a class of this embodiment, a plurality of monolayer coiled pipe arrays are vertically overlapped to form a multilayer coiled pipe array; and ends of monolayer coiled pipe arrays are connected to a plurality of the distribution openings and the collecting openings respectively.

1. The coiled pipe comprises a plurality of curved segments and straight segments integrally cast together; each said curved segment has a first end and a second end; each said straight segment is disposed between each two said curved segments; and flexing angle of each curved segment is larger than 180 degree, preferably 186-286 degree; the central lines of two adjacent curved segments have a common tangency point at the joint of the two adjacent curved segments; or the central lines of two adjacent curved segments are tangentially connected to the central line of a straight segment; in the above design, the bending part of the coiled pipe can be as long as possible within the minimum bending radius, and this may ensure the female screw thread or micro-fin structure is not deformed, meanwhile, it also saves space and achieves compact structure. Therefore, a small sized heat exchanger with a coiled pipe can be achieved, and more coiled pipes can be arranged in a unit volume compared with the prior art, so as to improve the efficiency of heat exchange.

2. A first side plate or the second side plate has a plurality of guiding devices, or both the first side plate and the second side plate respectively have a plurality of guiding devices disposed thereon; the guiding devices coordinate with the coiled pipe, and the generatrix of each guiding device is perpendicular to the first side plate and/or the second side plate respectively; preferably some of the guiding devices coordinate with the curved segments located on one side relative to a connection line between the first end and the second end of the curved segment, which are formed on the first side plate, and the other guiding devices are formed on the second side plate, in addition, the guiding device comprises a plurality of guiding pillars; each guiding pillar comprises a guiding cylinder and a connecting wall; the guiding cylinders coordinate with the curved segments; and a transition member is disposed on one end of the connecting wall, which is far from the guiding cylinder; the transition member coordinates with the curved segment adjacent thereto, and the housing-side fluid flows in the guiding device, which increases disturbance to the housing-side fluid, avoids the detention partial housing-side fluid, and improves the efficiency of heat exchange.

3. In the existing technology, the coiled pipe after penetrating into the housing is welded with the housing, and the coiled pipe cannot be disassembled from the housing, therefore, it is not easy to clean the coiled pipe, which may affect the efficiency of heat exchange between the coiled pipe and housing-side fluid. However, in this invention, the second side plate is in demountable connection with the frame body, and preferably the first side plate and/or the second side plate are/is in connection with the frame body via screw bolt(s). This design is advantageous for disassembling the coiled pipe arranged in the heat exchanger from the housing, so that it is easy to clean the coiled pipe.

4. In the heat exchanger of this invention, a sealed connection between the distribution tube and the distribution tube installation hole is formed via a first connection plate, which is in sealed connection with the distribution tube and integrally cast with the first side plate; a sealed connection between the effuser and the effuser installation hole is formed via a second connection plate, which is in sealed connection with the effuser and integrally cast with the first side plate, which ensures the quality of sealing between the distribution tube and effuser, and also the quality of sealing between the distribution tube and the first side plate, and allows the sealing not to be affected due to the disassembling of coiled pipe from the housing.

5. A plurality of monolayer coiled pipe arrays are vertically overlapped to form a multilayer coiled pipe array; and the ends of monolayer coiled pipe arrays are connected to a plurality of the distribution openings and the collecting openings respectively, which improves the scalability of the system in order to meet different customers' demands.

BRIEF DESCRIPTION OF THE DRAWINGS

Detailed description will be given below in conjunction with accompanying drawings.

Figure 1:
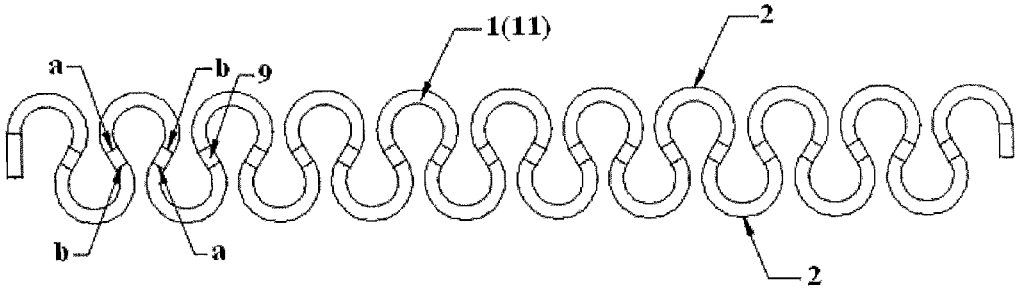
FIG. 1 illustrates a coiled pipe of this invention.

In the drawings, the following reference numbers are used: 1—coiled pipe, 11—monolayer coiled pipe array, 12—monolayer coiled pipe array, 2—curved segment, 3—housing, 31—first side plate, 32—second side place, 33—frame body, 34—first connection plate, 35—second connection plate, 4—distribution tube, 41—distribution opening, 5—effuser, 51—collecting opening, 6—water inlet, 7—water outlet, 8—guiding device, 80—guiding pillar, 801—guiding cylinder, 802—connecting wall, 81—generatrix, 9—straight segment, 10—housing-side passage, a—first end, b—second end.

DETAILED DESCRIPTION OF THE EMBODIMENTS

Referring to FIG. 1, the coiled pipe 1 comprises curved segments and straight segments integrally cast together; each curved segment has a first end and a second end; each straight segment is disposed between each two curved segments; and flexing angle of each curved segment 2 is larger than 180 degree, preferably 186 degree; the first end a and the second end b of the curved segment 2 are on the same plane. The central lines of two adjacent curved segments are tangentially connected to the central line of a straight segment 9; specifically, the first end a and the second end b are tangentially connected to the straight segment 9 respectively. Therefore, the bending part of the coiled pipe can be as long as possible, and this may ensure that the internal thread or micro-fin structure is not deformed, meanwhile, it is also space saving, improving the compactness of the structure. The flexing angle mentioned in this invention refers to the angle formed by the path of the plane moving from the first end a to the second end b, which is perpendicular to the central line of the coiled pipe.

Figure 2:
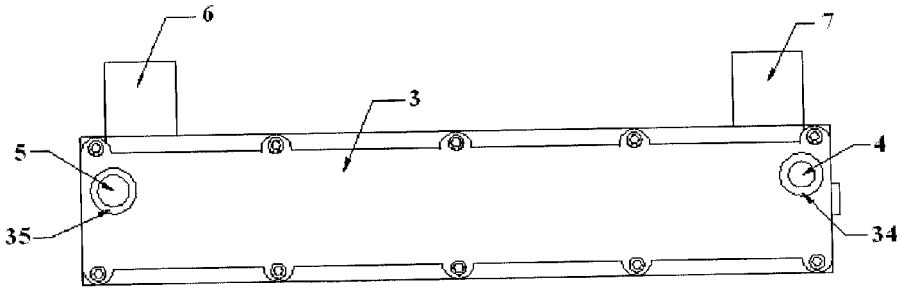
FIG. 2 illustrates a heat exchanger of this invention.

Referring to FIG. 2, a heat exchanger using the coiled pipe mentioned above comprises a housing 3 constituted by a frame body (33), a first side plate (31) and a second side plate (32) disposed opposite to said first side plate (31), and said first side plate (31) and said second side plate (32) are in sealed connection with said frame body to form an enclosure.

Figure 3:
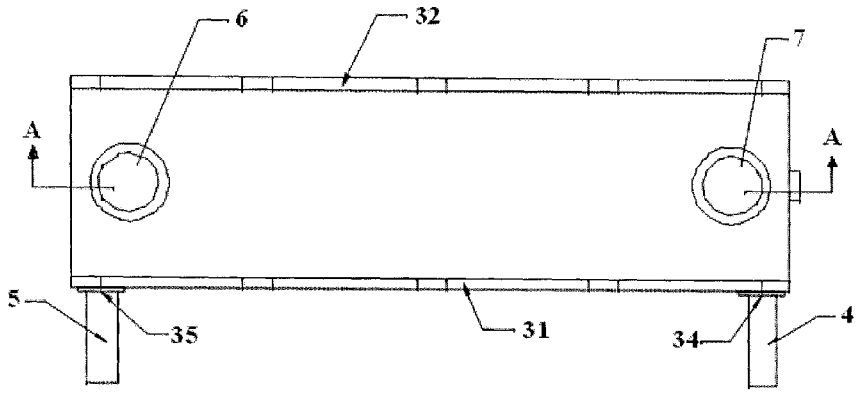
FIG. 3 is a top view of a heat exchanger of this invention.
Figure 4:
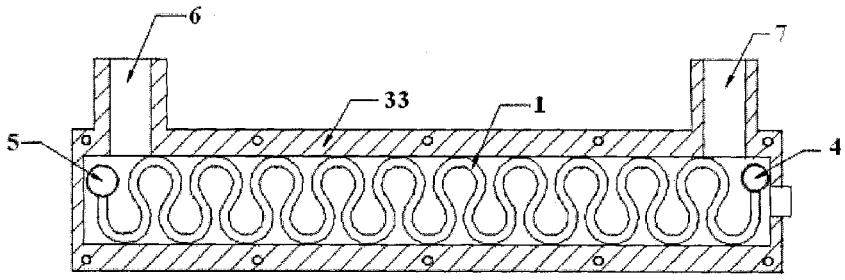
FIG. 4 is an A-A cross section view of FIG. 3.

A coiled pipe is placed inside the housing 3. In this embodiment, the coiled pipe is preferably parallel with the first side plate 31 and the second side plate 32 respectively, and referring to FIG. 1, it is a monolayer coiled pipe, and this means only one coiled pipe is arranged. The heat exchanger further comprises a distribution tube 4 and an effuser tube 5. The distribution tube 4 has a distribution opening 41 disposed thereon, and the effuser has a collecting opening 51 disposed thereon. One end of the coiled pipe is connected to the distribution opening 41, and the other end of the coiled pipe is connected to the collecting opening 51. Referring to FIG. 3 and FIG. 4, the distribution tube 4 and the effuser 5 respectively penetrate into the housing 3 and are in sealed connection with the same respectively through a distribution tube installation hole and an effuser installation hole formed on the housing.

Figure 7:
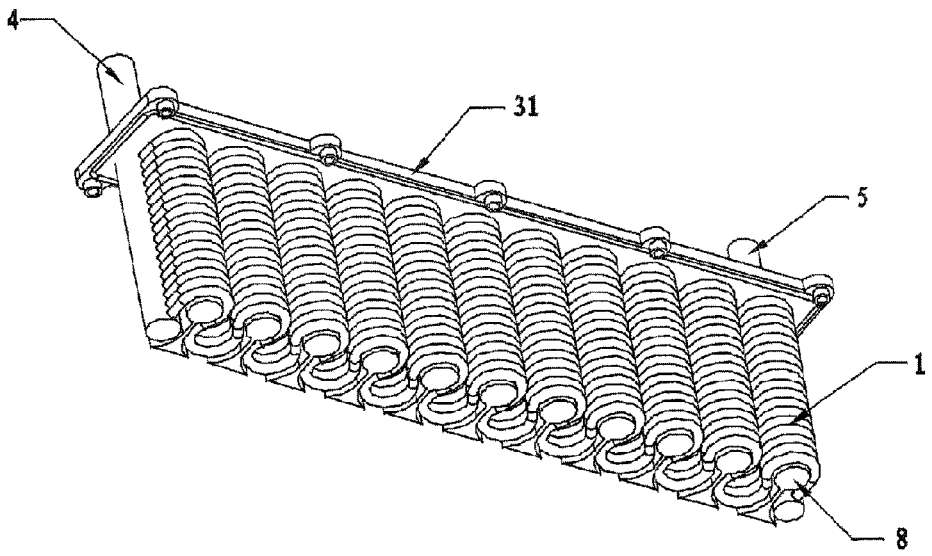
FIG. 7 illustrates a distribution tube and an effuser integrally cast with the first side plate.

In this embodiment, referring to FIG. 7, the distribution tube 4 is in a sealed connection with the distribution tube installation hole via a first connection plate, which is in sealed connection with the distribution tube 4 and integrally cast with the first side plate 31; the effuser 5 is in a sealed connection with the effuser installation hole via a second connection plate, which is in sealed connection with the effuser 5 and integrally cast with the first side plate 31.

Alternatively, the coiled pipe can be replaced by a multilayer coiled pipe, which is constituted by a plurality of monolayer coiled pipes vertically overlapped in a column and connected with each other. Furthermore, two ends of the multilayer coiled pipe are connected to the distribution opening 41 and the collecting opening 51. In this embodiment, one layer only has a monolayer coiled pipe disposed thereon, so that there are a plurality of layers of monolayer coiled pipes disposed in a column (illustrated in FIG. 7).

The housing 3 has a water inlet 6 and a water outlet 7 disposed thereon. One type of fluids for heat exchange is named tube side fluid, which flows in the tube, and the other type of fluid for heat exchange is named housing-side fluid, which flows outside the tube. The housing-side fluid flows into the housing via the water inlet 6, and it flows outside the coiled pipe 1 before exiting from the water outlet 7. The tube side fluid flows in through the distribution tube 4, and exchanges heat with the housing-side fluid through the coiled pipe 1, which realizes refrigeration or heating, after that it flows out through the effuser 5.

Figure 5:
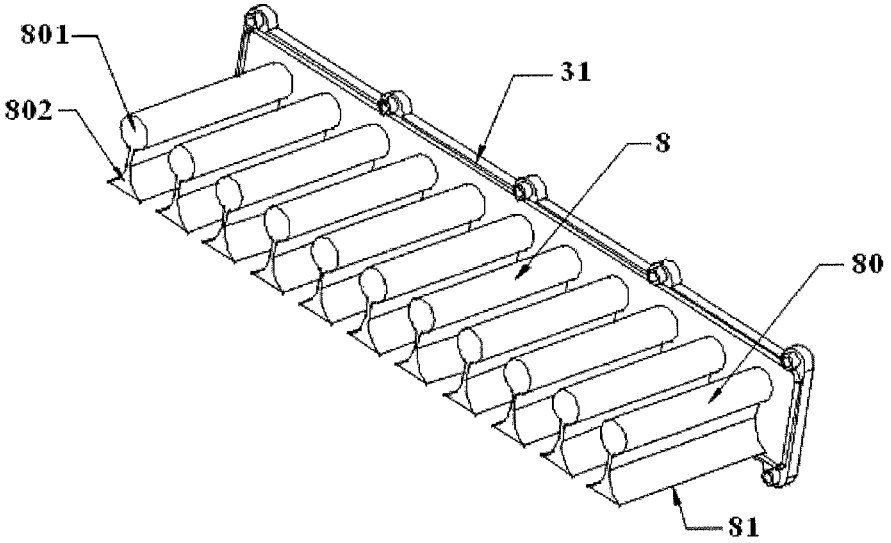
FIG. 5 illustrates the guiding device of the heat exchanger.

In addition, the first side plate 31 and the second side plate 32 have a plurality of guiding device 8 coordinating with the coiled pipe 1. Each of the guiding device 8 comprises a plurality of guiding pillars 80, and each guiding pillar 80 comprises a guiding cylinder 801 and a connecting wall 802. The guiding cylinder 801 coordinates with the curved segment 2. Referring to FIG. 5, a curved transition member that coordinates with the adjacent curved segment 2 is disposed on one end of connecting wall 802, which is far from the guiding cylinder 801. Some of the guiding devices 8 is formed on the first side plate 31, which coordinates with the curved segments located on one side relative to the connection line between the first end a and the second end b of the curved segment 2, and is defined as first guiding devices; the other guiding devices 8 are formed on the second side plate 32 and defined as second guiding devices.

Figure 6:
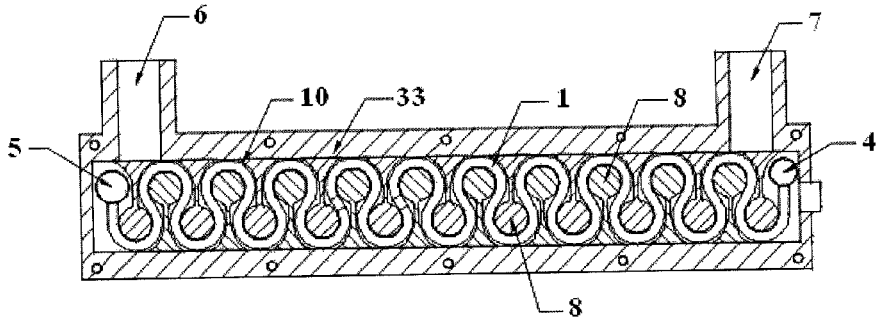
FIG. 6 illustrates an A-A cross section view of the heat exchanger shown in FIG. 3 with a guiding device.

The generatrixs 81 of the first guiding devices and the second guiding devices are perpendicular to the first side plate 31 and the second side plate 32 respectively. More specifically, each first guiding pillar penetrates through the space embraced by the curved segment of the curved segment 2 of the coiled pipe 1, and keeps clear from the curved segment 2; each second guiding pillar and the first side plate 31 penetrate through the space between every two adjacent curved segments 2, and keep clear from the curved segments 2. The first guiding device, the second guiding device, and the coiled pipe 1 form a housing-side passage 10 (illustrated in FIG. 6). The generatrix 81 is the elevating track of the cross section of the guiding pillar parallel with the first side plate, the orientation of which is perpendicular to the first plate.

Furthermore, the frame body 33 is in demountable connection with the first side plate 31, and the second side plate 32 is integrally cast with the frame body 33, which facilitates the demounting of the coiled pipe 1 from the housing 3. Preferably, the first side plate 31 is connected the frame body 33 through screw bolts, which facilitates the demounting of the coiled pipe 1 from the housing 3 for better cleaning the coiled pipe 1.

Preferably, the frame body 33 is in demountable connection with the first side plate 31 and the second side plate 32, and the coiled pipe is connected with the first side plate 31 and the second side plate 32 respectively through screw bolts.

Figure 8:
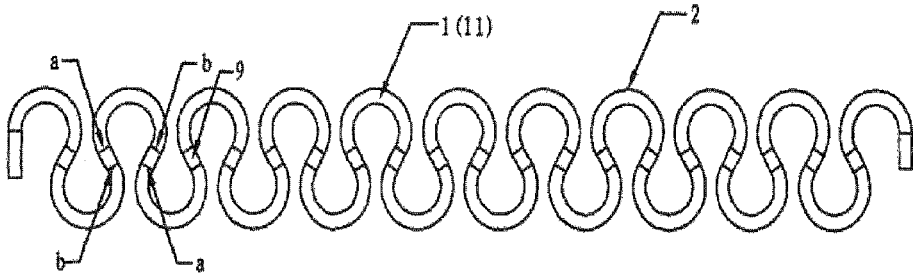
FIG. 8 illustrates a monolayer coiled pipe array of this invention.

As an alternative embodiment of this invention, referring to FIG. 8, the coiled pipe 1 comprises a plurality of curved segments 2 and straight segments 9 integrally cast together; each said curved segment has a first end a and a second end b; each said straight segment is disposed between each two said curved segments 2; the flexing angle of each curved segment 2 is larger than 180 degree, preferably 286 degree; the first end a and the second end b of curved segments 2 are on the same plane. The central lines of every two adjacent curved segments 2 have a common tangency point at the joint of the two adjacent curved segments 2.

Figure 9:
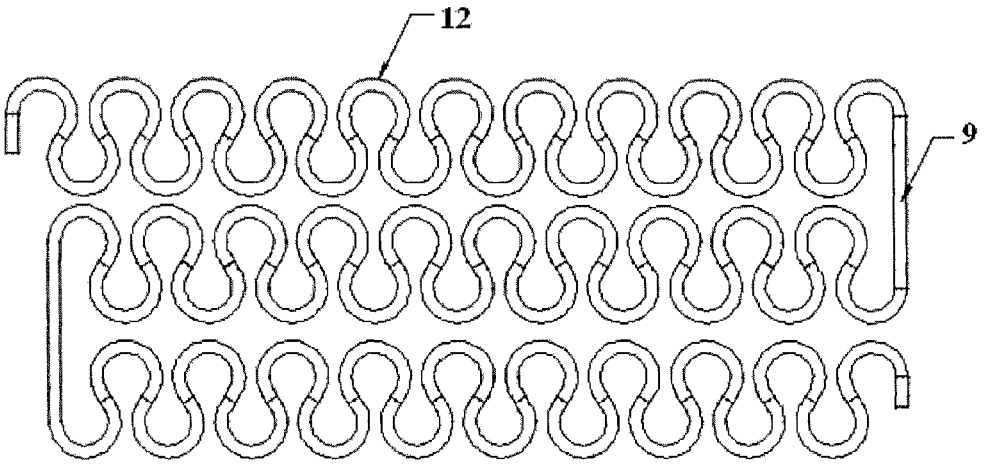
FIG. 9 illustrates a monolayer coiled pipe array of the heat exchanger.
Figure 10:
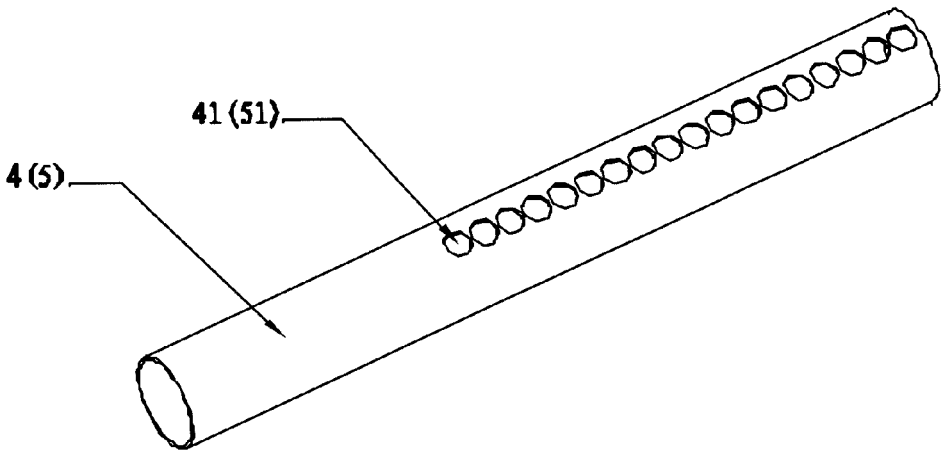
FIG. 10 illustrates the distribution tube or collecting tube of the heat exchanger.

On the basis of the design described in Embodiment 1, referring to FIG. 10, the multilayer coiled pipe can be replaced by a multilayer coiled pipe array comprising a plurality of monolayer coiled pipe arrays vertically overlapped and connected to each other through the ends thereof, wherein, the monolayer coiled pipe array comprising a plurality of monolayer coiled pipes horizontally arranged and connected to each other through the ends thereof. Each layer of the multilayer coiled pipe array is connected to the distribution opening 41 and the collecting opening 51 arranged at corresponding layer. In this embodiment, a straight segment 9 is preferably used to connect every two monolayer coiled pipes 11 in series. A plurality of monolayer coiled pipes 11 are vertically overlapped to constitute a multilayer coiled pipe 12 (referring to FIG. 9), thereby enlarging the area of heat exchange for the heat exchanger.

Furthermore, the first side plate 31 or the second side plate 32 has a plurality of guiding devices 8 coordinating with the coiled pipes 1. Wherein, all the guiding devices 8 are formed on the first side plate 31 or the second side plate 32, so as to achieve the objective of this invention. More specifically, the guiding devices 8 and the coiled pipes 1 form a housing-side passage 10.

What is claimed is:

1. A heat exchanger, comprising a housing, a distribution tube, an effuser and a coiled pipe; wherein said housing is constituted by a frame body, a first side plate and a second side plate disposed opposite to said first side plate, said first side plate and said second side plate are in sealed connection with said frame body to form an enclosure;

said distribution tube has a distribution opening disposed thereon and said effuser has a collecting opening disposed thereon;

said distribution tube and said effuser respectively penetrate into said housing and are in sealed connection with the housing through a distribution tube installation hole and an effuser installation hole formed on said housing; and said coiled pipe is placed inside said housing; one end of said coiled pipe is connected to said distribution opening while the other end of said coiled pipe is connected to said collecting opening; and said coiled pipe comprises a plurality of curved segments and straight segments integrally cast together; each said curved segment has a first end and a second end; each said straight segment is disposed between each two said curved segments; flexing angle of each said curved segment is larger than 180 degree; said first end and said second end of said curved segments are on the same plane; the central lines of two adjacent said curved segments have common tangency point at the joint of said two adjacent curved segments; or central lines of two adjacent said curved segments are tangentially connected to the central line of a straight segment;

said coiled pipe is disposed parallel with said first side plate and said second side plate; said first side plate or said second side plate has a plurality of guiding device formed thereon, or both said first side plate and said second side plate respectively have a plurality guiding device formed thereon; said guiding devices coordinate with said coiled pipe, and a generatrix of each said guiding device is perpendicular to said first side plate and/or said second side plate respectively, a sealed connection between said distribution tube and said distribution tube installation hole is formed through a first connection plate in sealed connection with said distribution tube and integrally cast with said first side plate; a sealed connection between said effuser and said effuser installation hole is formed via a second connection plate in sealed connection with said effuser and integrally cast with said first side plate.

2. The heat exchanger of claim 1, wherein said flexing angle of each curved segment is 186 degree-286 degree.

3. The heat exchanger of claim 2, wherein some of said guiding devices coordinate with said curved segments located on one side relative to a connection line between said first end and said second end of said curved segment, which are formed on said first side plate, and the other guiding devices are formed on said second side plate.

4. The heat exchanger of claim 3, wherein each said guiding device comprises a plurality of guiding pillars; each said guiding pillar comprises a guiding cylinder and a connecting wall; said guiding cylinders coordinate with said curved segments; and a transition member is disposed on one end of said connecting wall, which is far from said guiding cylinder; said transition member coordinates with said curved segment adjacent thereto.

5. The heat exchanger of claim 4, wherein said frame body is in demountable connection with said first side plate.

6. The heat exchanger of claim 5, wherein said frame body is in demountable connection with said second side plate.

7. The heat exchanger of claim 6, wherein said first side plate or said second side plate is connected with said frame body through a screw bolt, or both said first side plate and said second side plate are connected with said frame body through screw bolts.

8. The heat exchanger of claim 1, wherein a plurality of coiled pipes are connected to each other through a plurality of straight segments and disposed on the same plane to form a monolayer coiled pipe array; and two ends of said monolayer coiled pipe array are respectively connected to said distribution opening and said collecting opening.

9. The heat exchanger of claim 8, wherein a plurality of said monolayer coiled pipe arrays are vertically overlapped to form a multilayer coiled pipe array; and ends of said multilayer coiled pipe array are connected to a plurality of said distribution openings and said collecting openings respectively.

* * * * *